US008866832B2

(12) United States Patent
Morisada et al.

(10) Patent No.: US 8,866,832 B2
(45) Date of Patent: Oct. 21, 2014

(54) IMAGE PROCESSING DEVICE AND IMAGE PROCESSING METHOD FOR DISPLAYING HIGH RESOLUTION IMAGES

(75) Inventors: Hidehiko Morisada, Tokyo (JP); Akitsugu Komiyama, Tokyo (JP); Hiromasa Ohkubo, Kanagawa (JP)

(73) Assignees: Sony Corporation, Tokyo (JP); Sony Computer Entertainment Inc., Tokyo (JP)

( * ) Notice: Subject to any disclaimer, the term of this patent is extended or adjusted under 35 U.S.C. 154(b) by 195 days.

(21) Appl. No.: 13/440,095

(22) Filed: Apr. 5, 2012

(65) Prior Publication Data

US 2012/0256934 A1 Oct. 11, 2012

(30) Foreign Application Priority Data

Apr. 7, 2011 (JP) ..... 2011-085667

(51) Int. Cl.
*G09G 5/36* (2006.01)
*G09G 5/391* (2006.01)
*G09G 5/39* (2006.01)

(52) U.S. Cl.
CPC . *G09G 5/391* (2013.01); *G09G 5/39* (2013.01)
USPC ..... 345/545

(58) Field of Classification Search
CPC ..... G09G 5/393
USPC ..... 345/530, 539, 545, 548, 549
See application file for complete search history.

(56) References Cited

U.S. PATENT DOCUMENTS

2006/0170708 A1* 8/2006 Kyoung ..... 345/603
2010/0128045 A1* 5/2010 Inamoto et al. ..... 345/545

FOREIGN PATENT DOCUMENTS

JP 2007-293044 11/2007

* cited by examiner

*Primary Examiner* — David Zarka
*Assistant Examiner* — Terrell Robinson
(74) *Attorney, Agent, or Firm* — Katten Muchin Rosenman LLP

(57) ABSTRACT

A decoding execution unit decodes image data encoded with a resolution higher than that of a display device. A display buffer stores image data decoded by the decoding execution unit. A standby buffer stores image data decoded by the decoding execution unit while the image data stored in the display buffer is being displayed. A reduced image buffer stores image data produced by reducing the entirety of the image data. An image display control unit switches from the image data stored in the display buffer to the image data stored in the standby buffer if the decoding of the image data by the decoding execution unit is completed, and enlarges the image in the reduced image buffer and stores the enlarged image in the display buffer if the decoding of the image data by the decoding execution unit is not completed.

7 Claims, 7 Drawing Sheets

IMAGE PROCESSING DEVICE AND IMAGE PROCESSING METHOD FOR DISPLAYING HIGH RESOLUTION IMAGES

BACKGROUND OF THE INVENTION

1. Field of the Invention

The present invention relates to an image processing device and an image processing method.

2. Description of the Related Art

Imaging devices such as digital cameras are commonly used nowadays and users can obtain digital image data at ease. Dramatic improvements have been made in the performance of imaging devices. An ordinary user can capture digital image data with a resolution far exceeding 10 million pixels. Imaging devices capable of producing a high-definition (HD) panoramic image by panning a camera and performing image processing to blend a plurality of items of image data obtained by successively imaging an object from different viewpoints.

As the number of pixels in image data is increased, images cannot be viewed in full view on a living room television or on an ordinary personal computer (PC) monitor without reducing image data. Conversely, image data containing a large number of pixels will have to be displayed on a display device in a partial view if it is desired to view the image at a high resolution (e.g., in full size). If the displayed position in an image is changed or the image is enlarged or reduced while the image is being displayed, image processing such as decoding of the image may not be able to catch up with image display.

In one technique proposed to address the failure of image processing to catch up with image display, image data that should be displayed is prefetched for processing in order to smoothly display a list of thumbnails of a plurarity of items of image data.

[patent document No. 1] JP2007-293044

If the decoding of an image cannot catch up with the rendering of an image, the image data may not be viewed properly. For example, a part of the image may not be displayed or images with different resolutions may be displayed at respective areas.

SUMMARY OF THE INVENTION

The present invention addresses the aforementioned problem and a purpose thereof is to provide a technology of improving the rendering of an image with a resolution higher than that of the display device.

One embodiment of the present invention that solves the aforementioned problem relates to an image processing device. The device comprises: a decoding execution unit configured to decode image data encoded with a resolution higher than that of a display device; a display buffer configured to store image data decoded by the decoding execution unit and larger than a display area of the display device; a standby buffer configured to store image data decoded by the decoding execution unit while the display device is displaying the image data stored in the display buffer; a reduced image buffer configured to store image data produced by reducing the entirety of the image data decoded by the decoding execution unit; and an image display control unit configured to select one of the display buffer, the standby buffer, and the reduced image buffer so as to display the image data stored in the selected buffer on the display device. The image display control unit switches from the display buffer to the standby buffer such that the image display control unit uses the standby buffer as the display buffer if the decoding of the image data by the decoding execution unit is completed, and enlarges the image in the reduced image buffer and stores the enlarged image in the display buffer if the decoding of the image data by the decoding execution unit is not completed.

Another embodiment of the present invention relates to an image processing method. The method comprises: decoding image data encoded with a resolution higher than that of a display device; decoding image data larger than a display area of the display device and storing the image data in a display buffer; storing the decoded image data in a standby buffer while the display device is displaying the image data stored in the display buffer; storing image data produced by reducing the entirety of the decoded image data in a reduced image buffer; and switching from the display of the image stored in the display buffer to the display of the image stored in the standby buffer such that the standby buffer is used as the display buffer if the decoding of the image data for storage in the standby buffer is completed, and, the image in the reduced image buffer is enlarged and stored in the display buffer if the decoding of the image data for storage in the standby buffer is not completed.

Optional combinations of the aforementioned constituting elements, and implementations of the invention in the form of methods, apparatuses, systems, computer programs, data structures, and recording mediums may also be practiced as additional modes of the present invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

The invention will now be described by reference to the preferred embodiments. This does not intend to limit the scope of the present invention, but to exemplify the invention.

A summary of an embodiment of the present invention will be given. The image processing device according to the embodiment allows moving a window defined in a part of a high-definition image to display an image within the window on a display device such that the movement of the window is predicted to start decoding an image.

Figure 1:
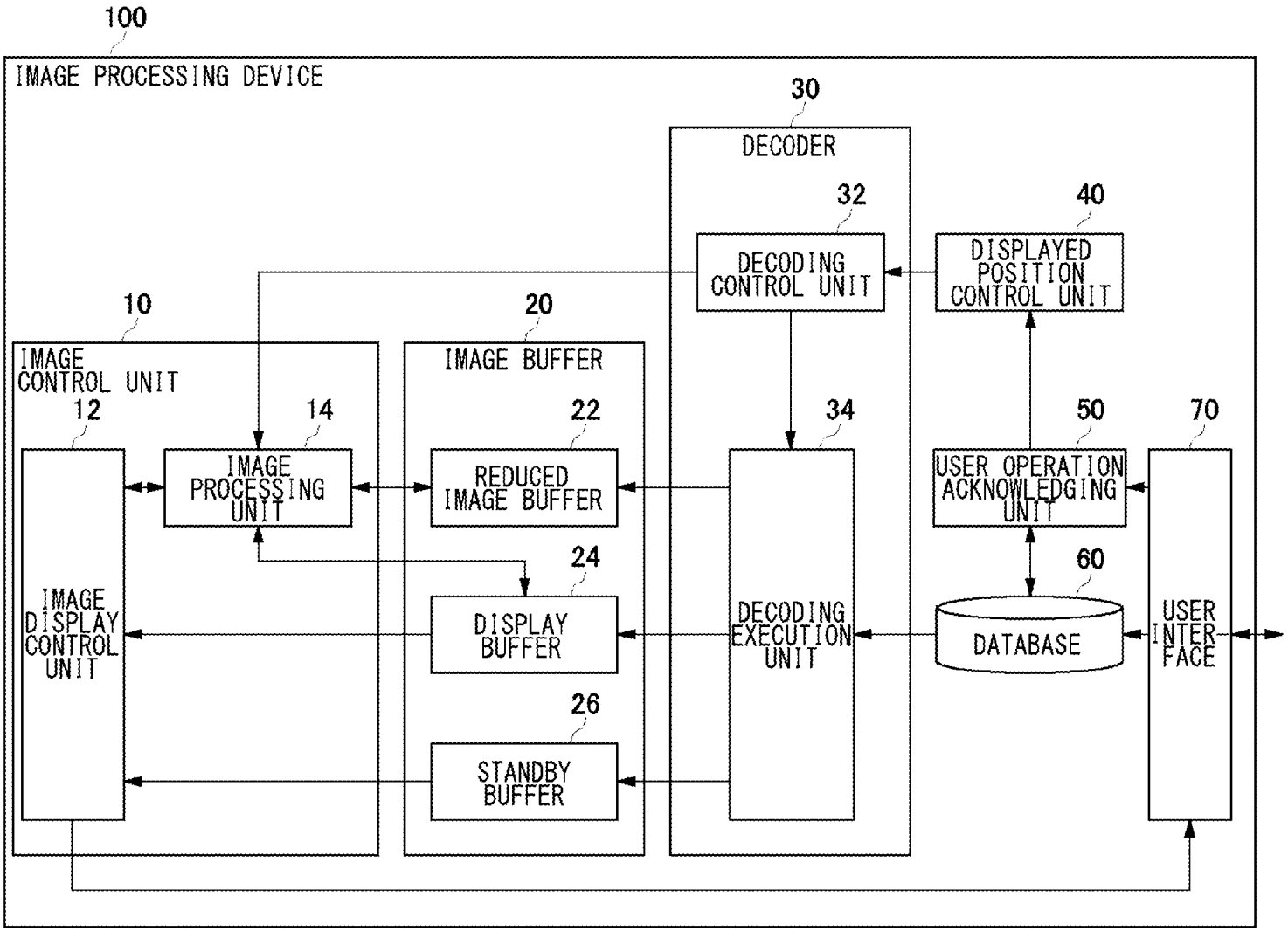
FIG. 1 shows the internal configuration of an image processing device according to the embodiment.

FIG. 1 shows the internal configuration of an image processing device 100 according to the embodiment. The image processing device 100 according to the embodiment comprises an image control unit 10, an image buffer 20, a decoder 30, a displayed position control unit 40, a user operation acknowledging unit 50, a database 60, and a user interface 70. FIG. 1 shows functional blocks that implement the image processing device 100 according to the embodiment and the other blocks are omitted. The elements depicted in FIG. 1 as functional blocks for performing various processes are implemented by hardware such as a CPU, a main memory, or other LSI's, and by software such as a programs etc., loaded into the main memory. Therefore, it will be obvious to those skilled in the art that the functional blocks may be implemented in a variety of manners by hardware only, software only, or a combination of thereof. One example of the image processing device 100 will be a desktop game device.

The database 60 primarily stores digital image data captured by a user. The database 60 may be implemented by a storage device such as a hard disk drive (HDD) or a solid state drive (SSD), or by a removable recording medium such as a Blu-ray disc (registered trademark). The image data stored in the database 60 may not only include ordinary two-dimensional images but also include three-dimensional images comprising pairs of a parallax image for the left eye and a parallax image for the right eye, or multi-angle images.

The user interface 70 acquires a user instruction directed to the image processing device 100 via an input device (not shown) such as a controller. The user interface 70 also outputs an image output by the image processing device 100 to a display device (not shown) such as a monitor.

The user operation acknowledging unit 50 acquires display parameters for controlling image display from a user via the user interface 70. Parameters for image display include the file name of image data that should be displayed, the displayed position in the image data, the factor by which the image is enlarged or reduced. The displayed position control unit 40 acquires the displayed position defined in a display buffer 24 (described later) and indicating the position in the image displayed on the display device.

The decoder 30 includes a decoding control unit 32 and a decoding execution unit 34. The decoder 30 acquires encoded image data from the database 60 and decodes the data. More specifically, if the image data acquired from the database 60 is encoded, the decoding execution unit 34 decodes the image data. If the image acquired from the database 60 is encoded with a resolution higher than that of the display device, the decoding execution unit 34 decodes image data for a part displayed on the display device.

The displayed position control unit 40 acquires a display parameter from the user via the user operation acknowledging unit 50 and acquires the displayed position indicating which part of the image data should be displayed. Provided that the image displayed on the display device is rectangular, the displayed position can be identified in, for example, the following manner. The displayed position control unit 40 defines an orthogonal coordinate system where the original is defined at an arbitrary point (e.g., the top left point) in the image data stored in the database 60. The displayed position control unit 40 identifies the coordinates at the ends of a diagonal line of the rectangle displayed on the display device and identifies the factor by which the image is enlarged or reduced. Instead of the coordinates at the ends of a diagonal line, the displayed position control unit 40 may identify the coordinates of a position at the beginning of the image and the number of pixels defining the height and the width.

One example of images with a resolution higher than that of the display device is a panoramic image. For example, HD panoramic images contain 4096 pixels in the height direction, 10480 pixels in the width direction, and a total of 43 megapixels. It is difficult to display such an image on the display device in full size. In many cases, a part of the image is displayed on a display device in full size or at a reduced scale.

Figure 2:
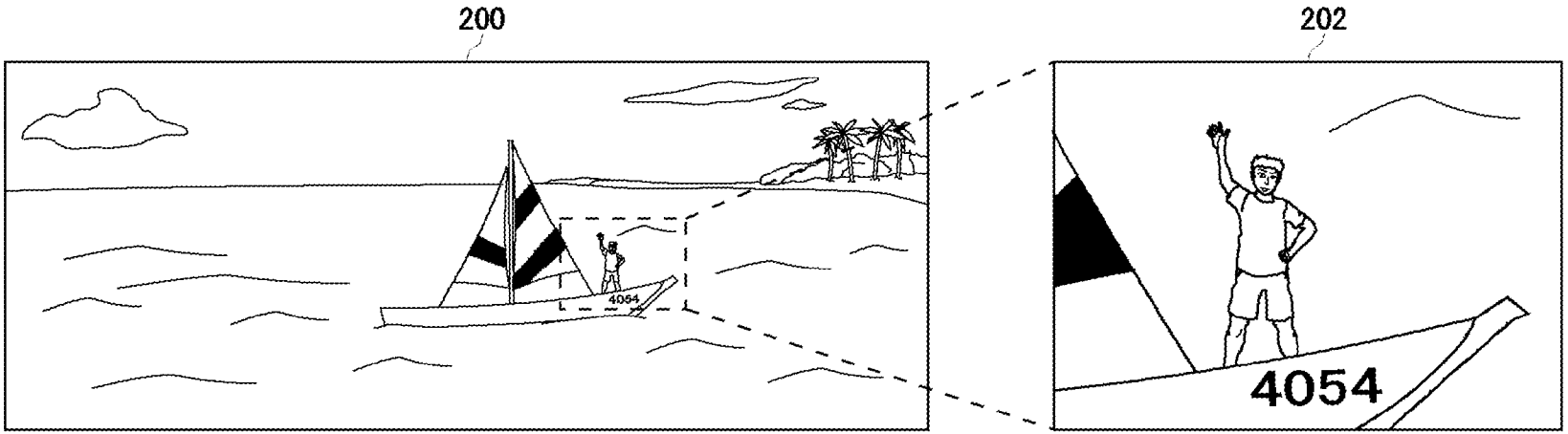
FIG. 2 shows an example of how a partial image displayed on a display device and the entirety of the image data are related.

FIG. 2 shows an example of how a partial image displayed on a display device and the entirety of the image data are related. Referring to FIG. 2, first image data 200 represents an exemplary HD panoramic image and second image data 202 represents a part of first image data 200 displayed on the display device. The user of the image processing device 100 can move the second image data 202 within the first image data 200 by manipulating a controller (not shown). The user can also change the display magnification of the second image data 202 by manipulating the controller. Enlarging the second image data 202 for display results in a smaller area being occupied by the second image data 202 in the first image data 200. Conversely, reduction of the second image data 202 for display results in a larger area being occupied by the second image data 202 in the first image data 200.

Reference is made back to FIG. 1. The decoding control unit 32 acquires display parameters from the displayed position control unit 40 and identifies image data that should be displayed on the display device. The decoding execution unit 34 decodes the image data identified by the decoding control unit 32.

The image buffer 20 stores the image data decoded by the decoding execution unit 34. The image buffer 20 stores the image data decoded by the decoding execution unit 34 in one of a reduced image buffer 22, a display buffer 24, and a standby buffer 26 in accordance with the use described later.

The display buffer 24 stores image data decoded by the decoding execution unit 34 and used for display on the display device. The decoding execution unit 34 decodes image data larger than the display area of the display device and the display buffer 24 stores image data larger than the display area of the display device.

As mentioned above, the second image data 202 is moved within the first image data 200 according to the user manipulation of the controller. Therefore, if the display buffer 24 stores an image of a size equal to that of the display area of the display device, movement of the second image data 202 by the user immediately requires decoding of new image data. If the user pans the camera or zooms the camera lens frequently, the computation in the decoding execution unit 34 may not catch up.

To address this, the display buffer 24 stores image data larger than the display area of the display device so that the image can be displayed without requiring further decoding processes so long as the user moves the second image data 202 within the image data stored in the display buffer 24. Moreover, a predetermined decoding start area is defined in the display buffer 24. When the displayed position of the second image data 202 reaches the defined area, the decoding control unit 32 causes the decoding execution unit 34 to start decoding image data. The decoding execution unit 34 stores newly decoded image data in the standby buffer 26. Thus, the display buffer 24 is used for the purpose of storing image data larger than the display area of the display device as decoded by the decoding execution unit 34. The standby buffer 26 is used for the purpose of storing image data decoded by the decoding execution unit 34 while the image data stored in the display buffer is being displayed on the display device.

A margin is provided in the display buffer 24 so that the buffer can store image data larger than the display area of the display device, and the standby buffer 26 is provided separately. This makes available a time for the decoding execution unit 34 to decode new image data and an area for storing decoded data. In the event that the displayed position of the second image data 202 reaches the edge of the display buffer 24, the standby buffer 26 is used as the display buffer 24 and the display buffer 24 is used as the standby buffer 26.

Figure 3:
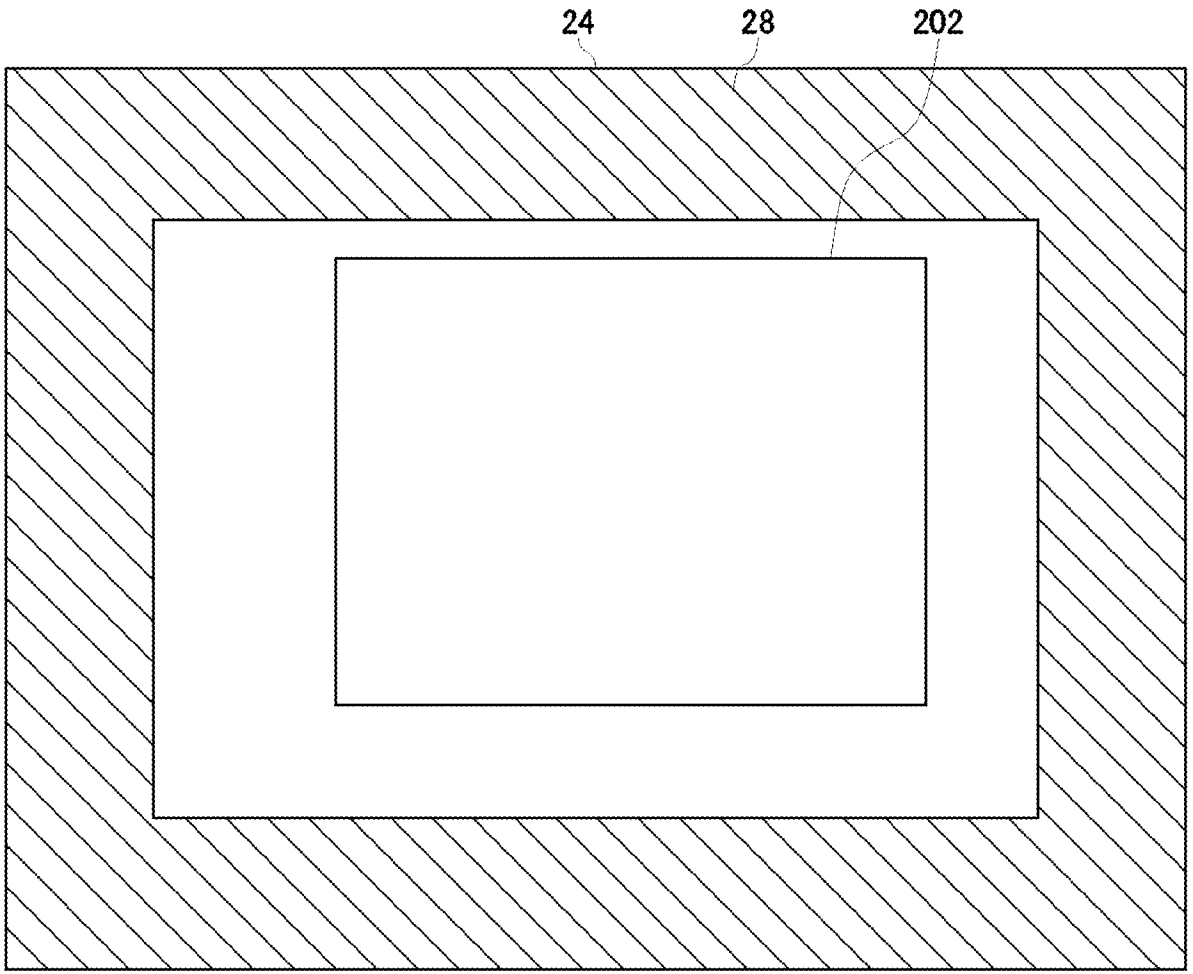
FIG. 3 schematically shows the configuration of the display buffer.

FIG. 3 schematically shows the configuration of the display buffer 24. As shown in FIG. 3, the image data stored in the display buffer 24 is larger than the second image data displayed by the display device. When the user manipulates the controller, the displayed position of second image data 202 in the display buffer 24 is moved accordingly. A decoding start area 28 is defined at the edge of the display buffer 24 indicated by hatching in FIG. 3. While the user is manipulating the controller, the displayed position control unit 40 monitors whether any part of the second image data 202 includes the decoding start area 28.

If the displayed position control unit 40 learns that the second image data 202 reaches the decoding start area 28 in the display buffer 24, the displayed position control unit 40 informs the decoding control unit 32 accordingly. The decoding control unit 32 causes the decoding execution unit 34 to start decoding the image data around the center of the second image data 202 occurring when the second image data 202 reaches the decoding start area 28.

Figure 4:
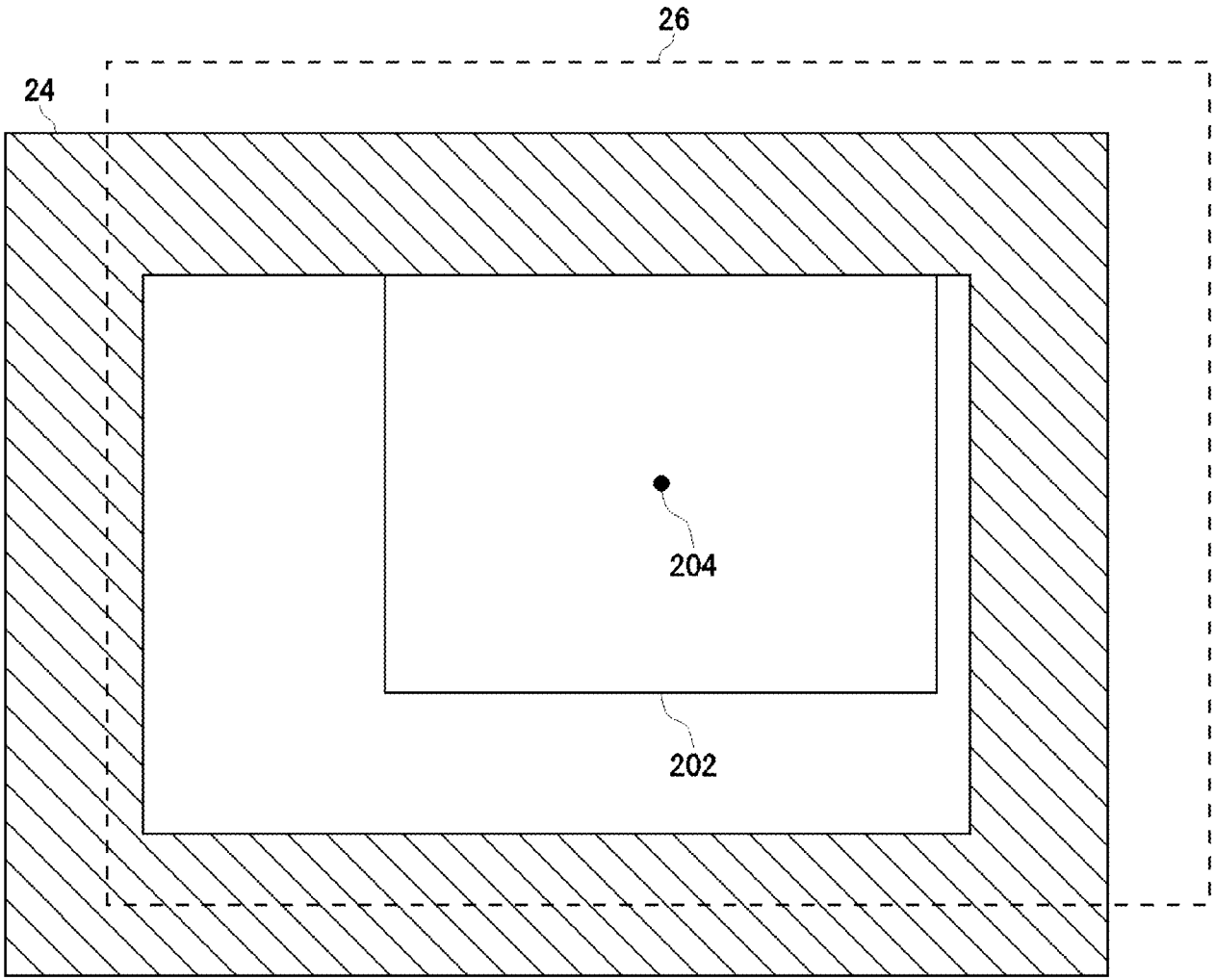
FIG. 4 shows an example of image data decoded by the decoding execution unit and stored in the standby buffer when the second image data reaches the decoding start area.

FIG. 4 shows an example of image data decoded by the decoding execution unit 34 and stored in the standby buffer 26 when the second image data 202 reaches the decoding start area 28. The user can change the position of the second image data 202 at will. Therefore, it is generally difficult for the decoding control unit 32 to predict image data that should be executed by the decoding execution unit 34.

Therefore, the decoding start area 28 is defined in the display buffer 24 so that, the decoding control unit 32 determines an area that should be decoded when the second image data 202 reaches the decoding start area 28 as shown in FIG. 4. By defining new image data around the center 204 of the second image data 202, the likelihood that the decoding of the image that should be displayed is completed is increased whichever direction the user subsequently moves the second image data 202.

The size of the display buffer 24 relative to the second image data 202 may be determined experimentally by considering the cost of a memory etc. used to implement the buffer. For example, the size may be sufficient to store image data twice the size of the second image data 202 in width and in height. The location of the decoding start area 28 in the display buffer 24 may also be determined experimentally. For example, 5% the length of the height of the image data that can be stored in the display buffer 24 at maximum may be defined as a margin from the edge of the display buffer 24.

Reference is made back to FIG. 1. The image control unit 10 outputs the image data stored in the buffers in the image buffer 20 to the display device via the user interface 70. For this purpose, the image control unit 10 includes an image display control unit 12 and an image processing unit 14.

The image processing unit 14 acquires the factor by which the image is enlarged or reduced from the decoding control unit 32. The image processing unit 14 enlarges or reduces the image data stored in the display buffer 24 accordingly. The image display control unit 12 selects the image data stored in the display buffer 24, the image data stored in the standby buffer 26, or the image data processed by the image processing unit 14 and outputs the selected image data to the display device for display. Thus, when a need arises to decode new image data as a result of the user moving the second image data 202, the image data in the display buffer 24 continues to be displayed until the decoding execution unit 34 completes the decoding and stores the decoded image data in the standby buffer 26. This secures a time necessary for the decoding execution unit 34 to decode the image data.

It should be noted that, even if the decoding control unit 32 preempts the user control and causes the decoding execution unit 34 to decode image data in anticipation, the decoding of image data by the decoding execution unit 34 may not catch up if the user moves the second image data 202 at a high speed or changes the factor by which the image is enlarged or reduced at a high speed. To address this, the decoding control unit 32 causes the decoding execution unit 34 to decode the entirety of the image data that should be displayed on the display device and causes the image processing unit 14 to reduce the entirety of the image data and store the reduced data in the reduced image buffer 22. Thus, the reduced image buffer 22 is used to store image data produced by causing the image processing unit 14 to reduce the entirety of the image data decoded by the decoding execution unit 34.

If the decoding of the image data by the decoding execution unit 34 is not completed when the displayed position control unit 40 learns that the second image data 202 reaches the edge of the display buffer 24, the image display control unit 12 causes the image processing unit 14 to enlarge the image data stored in the reduced image buffer 22 and store the enlarged data in the display buffer 24. Subsequently, the image display control unit 12 outputs the image data in the display buffer 24 to the display device. This will allow the image data to be displayed on the display device even if the decoding of the image data by the decoding execution unit 34 cannot catch up.

Instead of causing the image processing unit 14 to enlarge only the area in the reduced image buffer 22 corresponding to the area for which the decoding of the image data by the decoding execution unit 34 cannot catch up, the image display control unit 12 may cause the image processing unit 14 to enlarge the area in the reduced image buffer 22 corresponding to the entirety of the image data that should be displayed. This ensures that the image displayed on the display device is enlarged or reduced by a consistent factor, and prevents images with different resolutions from being displayed at respective parts.

If the decoding of the image data by the decoding execution unit 34 is completed while the image produced by causing the image processing unit 14 to enlarge the image in the reduced image buffer 22 and store the enlarged data in the display buffer 24 is being displayed, the image display control unit 12 switches the standby buffer 26 into use as the display buffer 24. This allows switching to a high-resolution image displayed on the display device in a single step.

Figure 5:
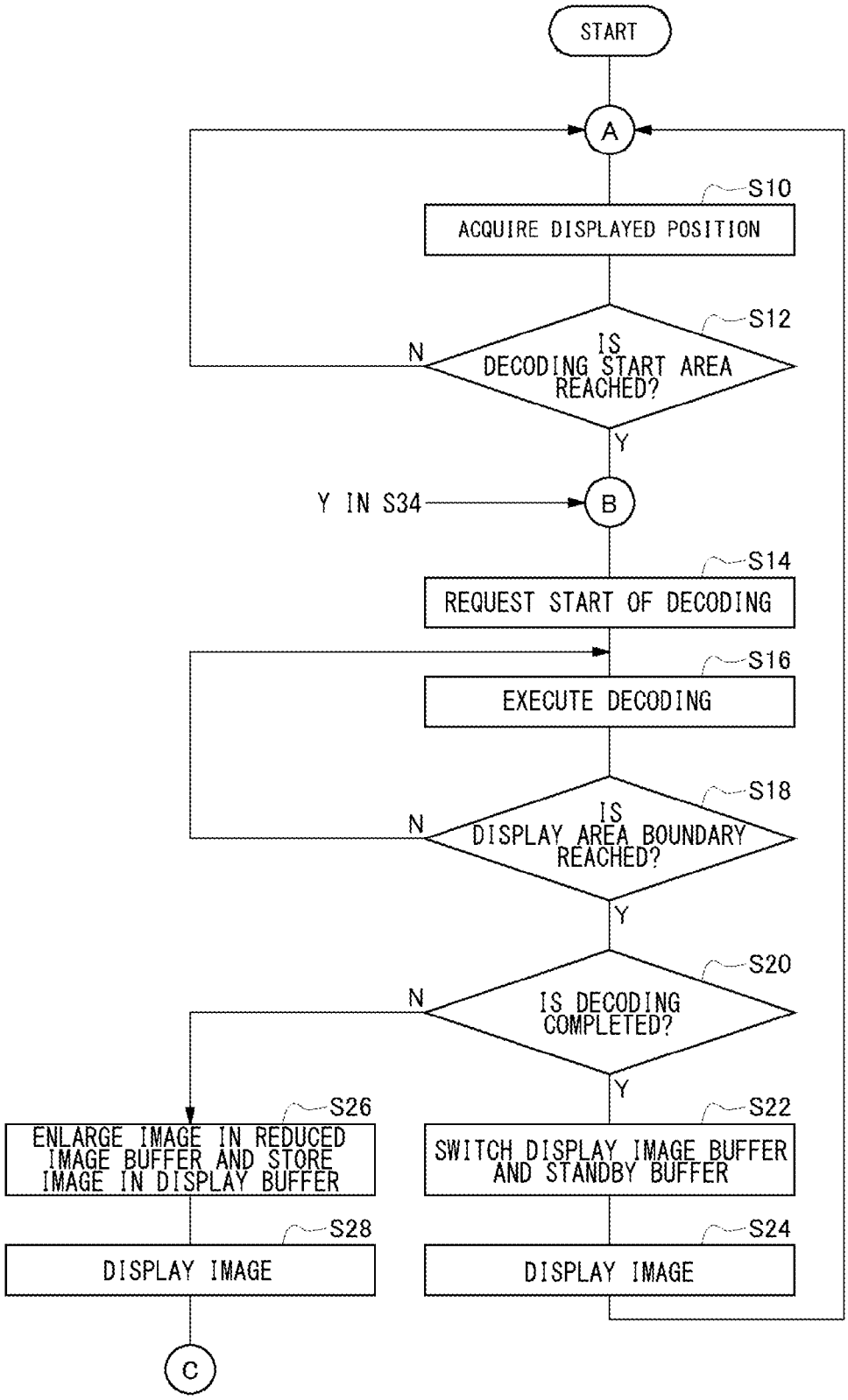
FIG. 5 shows the first part of a flowchart showing the flow of the process in the image processing device according to the embodiment.

FIG. 5 shows the first part of a flowchart showing the flow of the process in the image processing device 100 according to the embodiment. The process according to the flow chart is started when the image processing device 100 is powered on.

The displayed position control unit 40 acquires the coordinates indicating the position defined in the second image data 202 that should be displayed on the display device via the user interface 70 and the user operation acknowledging unit 50 (S10). The displayed position control unit 40 refers to the acquired positional coordinates to determine whether the second image data 202 reaches the decoding start area 28 in the display buffer 24.

If the second image data 202 does not reach the decoding start area 28 in the display buffer 24 (N in S12), control is returned to step S10, whereupon the displayed position control unit 40 continues to acquire the positional coordinates.

If the second image data 202 reaches the decoding start area 28 in the display buffer 24 (Yi in S12), the displayed position control unit 40 notifies the decoding control unit 32 accordingly. The decoding control unit 32 causes the decoding execution unit 34 to start decoding new image data (S14). The decoding execution unit 34 decodes new image data around the center of the second image data 202 occurring when the decoding execution unit 34 is directed by the decoding control unit 32 to start decoding (S16).

While the second image data 202 does not reach the boundary of the display buffer 24 (N in S18), the decoding execution unit 34 continues to decode new image data. If the decoding of the image data by the decoding execution unit 34 is completed (Y in S20) when the second image data 202 reaches the edge of the display buffer 24 (Y in S18), the image display control unit 12 switches between the display buffer 24 and the standby buffer 26 (S22).

Subsequently, the image display control unit 12 uses the standby buffer 26 as a new display image buffer and outputs the image data stored therein to the display device for display (S24). When the image display control unit 12 outputs the image data, control is returned to step S10.

If the decoding of image data by the decoding execution unit 34 is not completed (N in S20) when the second image data 202 reaches the edge of the display buffer 24 (Y in S18), the image display control unit 12 causes the image processing unit 14 to enlarge the image stored in the reduced image buffer 22 and store the enlarged data in the display buffer (S26). The image display control unit 12 outputs the image stored in the display buffer to the display device for display (S28).

Figure 6:
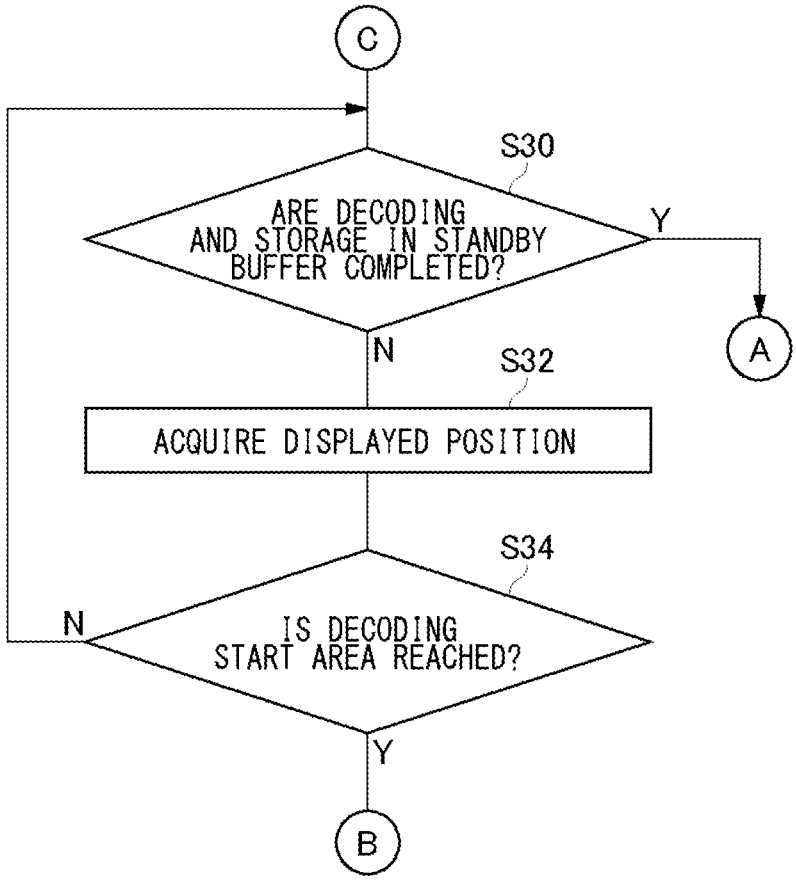
FIG. 6 shows the second part of a flowchart showing the flow of the process in the image processing device 100 according to the embodiment.

FIG. 6 shows the second part of a flowchart showing the flow of the process in the image processing device 100 according to the embodiment.

When the decoding of new image data by the decoding execution unit 34 is completed and the decoded data is stored in the standby buffer 26 after the image display control unit 12 has enlarged the image stored in the reduced image buffer 22 for display (Y in S30), control is returned to step S10 in FIG. 5 so that subsequent processing is continued.

While the decoding of new image data by the decoding execution unit 34 remains uncompleted after the image display control unit 12 has enlarged the image stored in the reduced image buffer 22 for display (N in S30), the displayed position control unit 40 acquires the coordinates indicating the position in the second image data 202 that should be displayed on the display device (S32). The displayed position control unit 40 refers to the acquired positional coordinates to determine whether the second image data 202 reaches the decoding start area 28 in the display buffer 24.

If the second image data 202 does not reach the decoding start area 28 in the display buffer 24 (N in S34), control is returned to step S30, whereupon the decoding control unit 32 continues to monitor whether the decoding of new image data by the decoding execution unit 34 is completed. If the second image data 202 reaches the decoding start area 28 in the display buffer (Y in S34), control is returned to step S14 in FIG. 5, so that subsequent processing is performed.

By repeating the steps S10 through S34 shown in FIGS. 5 and 6, the image processing device 100 decodes the image data stored in the database 60 and displays the image on the display device.

The operation according to the configuration as described is summarized as follows. The user uses the image processing device 100 to display a part of the image data stored in the database 60 containing the number of pixels larger than the number of pixels that the display device is capable of displaying. The displayed position control unit 40 acquires the coordinates indicating the position of the image that should be displayed. The decoding control unit 32 causes the decoding execution unit 34 to decode the image data at the positional coordinates acquired by the displayed position control unit 40 and store the decoded data in the display buffer 24.

The display buffer 24 is provided with a margin and stores image data larger than the image data that should be displayed. When a need arises to decode new image data as a result of the user moving the displayed position, the image display control unit 12 outputs the image data stored in the margin of the display buffer 24. Meanwhile, the decoding execution unit 34 decodes new image data and store the decoded image in the standby buffer 26. If the decoding process by the decoding execution unit 34 catches up, the image display control unit 12 switches from the display buffer 24 to the standby buffer 26 and displays the image data stored in the standby buffer 26. Meanwhile, the display buffer 24 is used as a standby buffer.

If the decoding process by the decoding execution unit 34 does not catch up, the image display control unit 12 extracts image data that should be displayed, from the reduced image representing the entirety of image data and stored in the reduced image buffer 22 in advance. The image display control unit 12 enlarges the extracted image and displays the enlarged image.

As described above, the image processing device 100 of the embodiment is capable of providing a technology capable of improving the rendering of an image with a resolution higher than that of the display device. In particular, the inventive device is capable of preventing the failure of a part of the display image to be displayed due to the failure of an image decoding process to catch up with image display, and preventing images with different resolutions from being displayed at respective parts.

Described above is an explanation based on an exemplary embodiment. The embodiment is intended to be illustrative only and it will be obvious to those skilled in the art that various modifications to constituting elements and processes could be developed and that such modifications are also within the scope of the present invention.

In the description given above, it is assumed that the user can control the position of a displayed image at will while a part of image data with a resolution higher than a display device is being displayed. The displayed position control unit 40 is also provided with an autoscrolling mode of panning over the image data so that the entirety of image data is scanned and displayed. The user can configure the displayed position control unit 40 for the autoscrolling mode via the user interface 70 and the user operation acknowledging unit 50. A description will be given of the operation of the blocks in the image processing device 100 performed when the displayed position control unit 40 is configured for the autoscrolling mode.

Figures 7A, 7B:
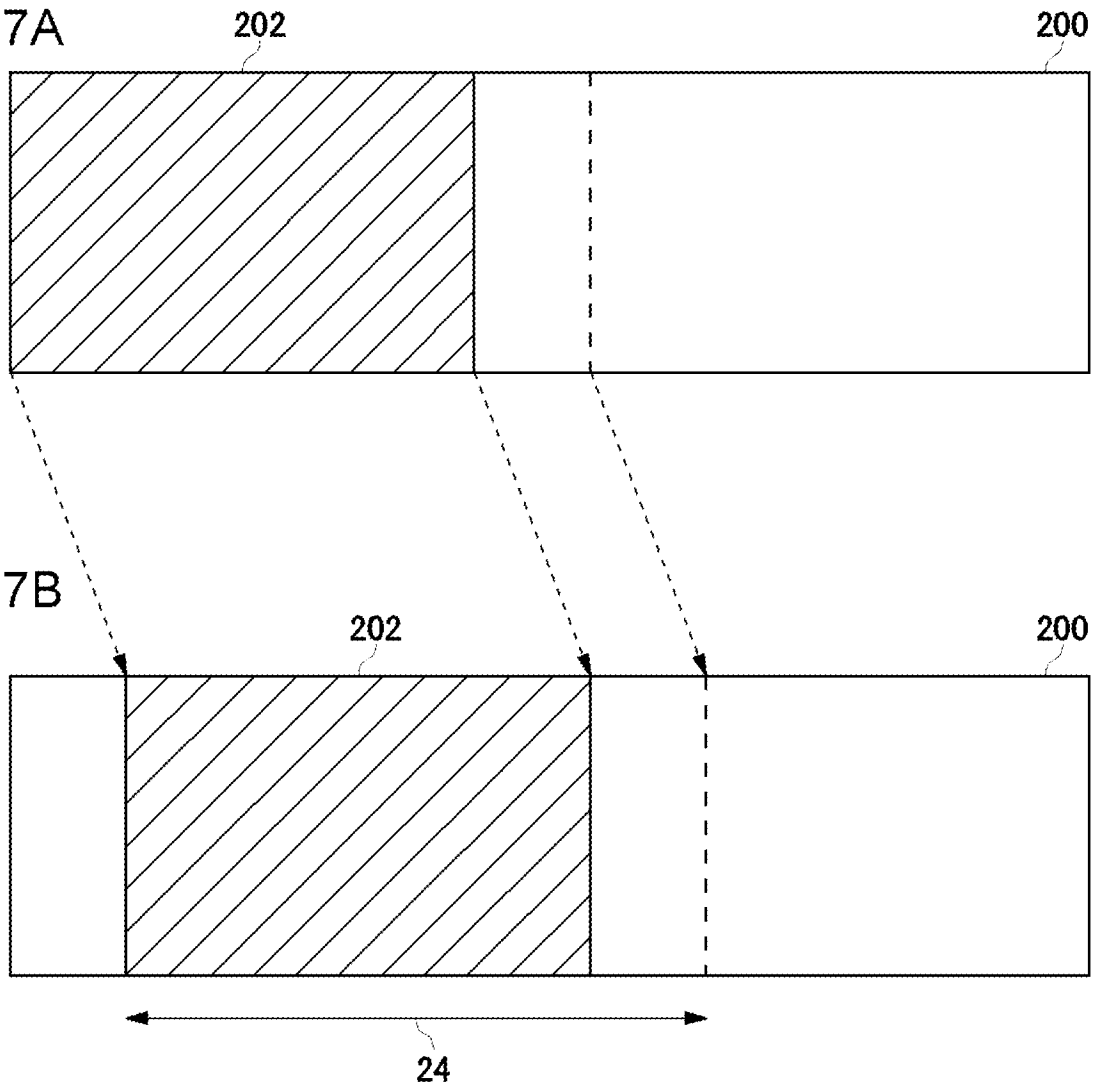
FIGS. 7A and 7B show the relative sizes of the first image data, the second image data, and the image data stored in the display buffer occurring when the displayed position control unit is configured for the automatic scroll mode.

FIGS. 7A and 7B show the relative sizes of the first image data 200, the second image data 202, and the image data stored in the display buffer 24 occurring when the displayed position control unit 40 is configured for the autoscrolling mode. FIG. 7A shows the relative sizes occurring when the displayed position control unit 40 starts autoscrolling. FIG. 7B shows the relative sizes occurring when the second image data 202 is moved inside the first image data 200.

The displayed position control unit 40 initially defines the second image data 202 at one longitudinal end of the first image data 200 and moves the displayed position of the second image data 202 at a constant speed until the second image data 202 reaches the other longitudinal end of the first image data 200.

When the displayed position control unit 40 defines the second image data 202 at one longitudinal end of the first image data 200, the decoding control unit 32 causes the decoding execution unit 34 to decode image data of a size larger in the longitudinal direction of the first image data 200 than the second image data 202.

The display buffer 24 stores the image data decoded by the decoding execution unit 34. The image display control unit 12 refers to the displayed position configured by the displayed position control unit 40 and outputs the corresponding image data in the display buffer 24 to the display device. Since the displayed position control unit 40 moves the displayed position of the second image data 202 at a constant speed, it is possible to calculate a time required for the second image data 202 to reach the boundary of the display buffer 24. More specifically, given that the display buffer 24 stores image data larger in size than the second image data 202 by A pixels in the longitudinal direction of the first image data 200, and provided that the moving speed of the displayed position of the second image data 202 is B pixels per second, the time required for the second image data 202 to reach the boundary of the display buffer 24 will be A/B seconds.

The decoding execution unit 34 predicts the time required for the second image data 202 to reach the boundary of the display buffer 24. The decoding execution unit 34 decodes image data that should be displayed before the second image data 202 reaches the boundary of the display buffer 24. The decoding execution unit 34 stores the decoded image data in the standby buffer 26. The image display control unit 12 switches the display buffer 24 to the standby buffer 26. Subsequently, the image display control unit 12 uses the standby buffer 26 as a display buffer and uses the display buffer 24 as a standby buffer. Thus, the image display control unit 12 uses the display buffer 24 and the standby buffer 26, alternately switching between the buffers. whereby it is possible secure a time required for the decoding execution unit 34 to complete the decoding.

If the first image data 200 is a panoramic image produced by blending a plurality of items of image data obtained by capturing images of an object successively from a plurality of different viewpoints, the panoramic image may contain additional information recorded thereon indicating which of the longitudinal directions the images were started to be taken in, depending on the type of the camera in which image processing is performed.

If the image data contains additional information which direction the images were taken in, the displayed position control unit 40 may start autoscrolling in the direction in which the image data was taken. This allows autoscrolling to be performed in the same direction in which the user moved the camera to take successive images. This is advantageous in that autoscrolling is performed in the same direction in which the user moved the camera to take successive pictures, even if the image data is rotated or inverted from side to side.

What is claimed is:

1. An image processing device comprising:

a decoding execution unit configured to decode image data encoded with a resolution higher than that of a display device;

a display buffer configured to store image data decoded by the decoding execution unit and larger than a display area of the display device;

a standby buffer configured to store image data decoded by the decoding execution unit while the display device is displaying the image data stored in the display buffer;

a reduced image buffer configured to store image data produced by reducing the entirety of the image data decoded by the decoding execution unit; and an image display control unit configured to select one of the display buffer, the standby buffer, and the reduced image buffer so as to display the image data stored in the selected buffer on the display device, wherein the image display control unit switches from the display buffer to the standby buffer such that the image display control unit uses the standby buffer as the display buffer if the decoding of the image data by the decoding execution unit is completed, and enlarges the image in the reduced image buffer and stores the enlarged image in the display buffer if the decoding of the image data by the decoding execution unit is not completed.

2. The image processing device according to claim 1, further comprising:

a displayed position control unit configured to acquire a displayed position of the image data stored in the display buffer and displayed on the display device, wherein the decoding execution unit starts decoding image data around the center of the display area to store the decoded image data in the standby buffer, when the displayed position control unit learns that the displayed position reaches a decoding start area defined in the display buffer.

3. The image processing device according to claim 2, wherein, if the decoding of the image data by the decoding execution unit is completed when the displayed position control unit learns that the displayed position reaches a boundary of the display buffer, the image display control unit uses the standby buffer as the display buffer.

4. The image processing device according to claim 3, wherein the image display control unit enlarges the image in the reduced image buffer and stores the enlarged image in the display buffer if the decoding of the image data by the decoding execution unit is not completed when the displayed position control unit learns that the displayed position reaches a boundary of the display buffer.

5. The image processing device according to claim 4, wherein the image display control unit uses the standby buffer as the display buffer both if the decoding of the image data by the decoding execution unit is not completed when the displayed position control unit learns that the displayed position reaches the boundary of the display buffer, and if the decoding of the image data by the decoding execution unit is completed after the image display control unit enlarges the image in the reduced image buffer and stores the enlarged image in the display buffer.

6. An image processing method comprising:

decoding image data encoded with a resolution higher than that of a display device;

decoding image data larger than a display area of the display device and storing the image data in a display buffer;

storing the decoded image data in a standby buffer while the display device is displaying the image data stored in the display buffer;

storing image data produced by reducing the entirety of the decoded image data in a reduced image buffer; and switching from the display of the image stored in the display buffer to the display of the image stored in the standby buffer such that the standby buffer is used as the display buffer if the decoding of the image data for storage in the standby buffer is completed, and, the image in the reduced image buffer is enlarged and stored in the display buffer if the decoding of the image data for storage in the standby buffer is not completed.

7. A program embedded in a non-transitory computer-readable recording medium, the program comprising:

a module configured to decode image data encoded with a resolution higher than that of a display device;

a module configured to decode image data larger than a display area of the display device and store the image data in a display buffer;

a module configured to store the decoded image data in a standby buffer while the display device is displaying the image data stored in the display buffer;

a module configured to store image data produced by reducing the entirety of the decoded image data in a reduced image buffer; and a module configured to switch from the display of the image stored in the display buffer to the display of the image stored in the standby buffer such that the standby buffer is used as the display buffer if the decoding of the image data for storage in the standby buffer is completed, and, the image in the reduced image buffer is enlarged and stored in the display buffer if the decoding of the image data for storage in the standby buffer is not completed.

* * * * *